US006720286B2

(12) United States Patent
Mitsuo et al.

(10) Patent No.: US 6,720,286 B2
(45) Date of Patent: Apr. 13, 2004

(54) HEAT-SENSITIVE RECORDING MATERIAL

(75) Inventors: Hirofumi Mitsuo, Shizuoka-ken (JP); Masayuki Iwasaki, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 93 days.

(21) Appl. No.: 09/949,865

(22) Filed: Sep. 12, 2001

(65) Prior Publication Data

US 2002/0061818 A1 May 23, 2002

(30) Foreign Application Priority Data

Sep. 11, 2000 (JP) ..... 2000-275344

(51) Int. Cl.[7] ..... B41M 5/30

(52) U.S. Cl. ..... 503/201; 503/208; 503/209; 503/216

(58) Field of Search ..... 503/208, 209, 503/201, 216

(56) References Cited

U.S. PATENT DOCUMENTS 4,771,034 A * 9/1988 Ikeda et al. ..... 503/212
5,876,898 A * 3/1999 Ikeda et al. ..... 430/203

FOREIGN PATENT DOCUMENTS

| | | |
|---|---|---|
| EP | 0 058 083 A2 | 8/1982 |
| EP | 0 562 824 A2 | 9/1993 |
| EP | 0 675 002 A1 | 10/1995 |

* cited by examiner

*Primary Examiner*—B. Hamilton Hess
(74) *Attorney, Agent, or Firm*—Sughrue Mion, PLLC

(57) ABSTRACT

A heat-sensitive recording material comprising a substrate and a heat-sensitive coloring layer containing a colorless electron-donating dye, an electron-accepting compound including at least 4,4'-dihydroxydiphenylsulfone, and a sensitizer comprising 2-benzyloxynaphthalene and aliphatic monoamide in the mass ratio in a range of 30/70 to 70/30.

18 Claims, No Drawings

HEAT-SENSITIVE RECORDING MATERIAL

BACKGROUND OF THE INVENTION

1. Field of the Invention

The present invention relates to a heat-sensitive recording material, particularly to a heat-sensitive recording material having high coloring density, little fogging at non-image portions and excellent image preservability.

2. Description of the Related Art

Generally, heat-sensitive recording materials have been widely used for the reason that the heat-sensitive recording materials are relatively inexpensive, and because recording equipment therefor is compact and maintenance-free. Under such circumstances, recently, sales of heat-sensitive paper have become competitive, there has been a demand for heat-sensitive recording materials having functions greater than those of the past. Moreover, coloring density, image preservability, and the like of heat-sensitive recording materials are being extensively researched.

As electron-accepting compounds for colorless electron-donating dyes used for such heat-sensitive recording materials, conventionally, 2,2-bis (4-hydroxyphenyl) propane (so-called "bisphenol A") has been widely used. However, a compound satisfying demands made with respect to sensitivity, fogging and image preservability has not been obtained yet.

Further, there has been an escalation in recent years in the use of ink jet printers. Accompanying this escalation has been a trend to overlap ink jet recording sheet and heat-sensitive recording material after an image has been recorded thereon.

However, when an ink jet recording sheet and a heat-sensitive recording material, with images recorded thereon, are placed so as to overlap each other, respective recording surfaces thereof contact each other. In conventional heat-sensitive recording materials, there is the problem that density of image portions becomes low and fogging of non-image portions grows worse. As a result, there have been cases in which the purpose of the heat-sensitive recording material as a recording material is compromised.

SUMMARY OF THE INVENTION

Accordingly, an object of the present invention is to provide a heat-sensitive recording material having high coloring density, little fogging at non-image portions, and excellent preservability of image portions.

As a result of their investigations into electron-accepting compounds, sensitizers, and the like, the present inventors strove to develop a recording material having excellent functional properties and completed the present invention. Namely, a first aspect of the present invention is a heat-sensitive recording material comprising: a substrate; and a heat-sensitive coloring layer formed on the substrate, the heat-sensitive coloring layer including (a) a colorless electron-donating dye, (b) an electron-accepting compound including at least 4,4'-dihydroxydiphenylsulfone, and (c) a sensitizer comprising 2-benzyloxynaphthalene and aliphatic monoamide.

A second aspect of the present invention is a method of forming a heat-sensitive recording material, comprising the steps of: (a) dispersing a colorless electron-donating dye, an electron-accepting compound, comprising at least 4,4'-dihydroxydiphenylsulfone, and a sensitizer comprising 2-benzyloxynaphthalene and aliphatic monoamide in a water-soluble binder to form a coating material; (b) drying a film of the coating material on a substrate to form a heat-sensitive coloring layer; and (c) smoothing the heat-sensitive coloring layer.

DESCRIPTION OF THE PREFERRED EMBODIMENTS

A heat-sensitive recording material of the present invention comprises a substrate, and a heat-sensitive coloring layer disposed on the substrate and containing a colorless electron-donating dye and an electron-accepting compound. The above-described heat-sensitive coloring layer contains, as the electron-accepting compound, at least 4,4'-dihydroxydiphenylsulfone, and also contains a sensitizer comprised of 2-benzyloxynaphthalene and aliphatic monoamide in a mass ratio (2-benzyloxynaphthalene/aliphatic monoamide) ranging from 30/70 to 70/30. The heat-sensitive recording material of the present invention will be hereinafter described.

1. Substrate

Conventionally known substrates can be used as the substrate in the present invention. Specifically, paper substrates of fine-quality paper, coat paper with resin or pigment applied thereto, resin-laminated paper, fine-quality paper having an undercoat layer, synthetic paper, plastic film, and the like can be used.

A smooth substrate in which smoothness prescribed by JIS-8119 is in a range of 300 to 500 seconds is preferable as the substrate from the standpoint of dot reproducibility.

The substrate used in the present invention may also include an undercoat layer. When an undercoat layer is provided on the substrate, an undercoat layer containing a pigment as a main component is preferably used. Conventional organic and inorganic pigments can be used. Particularly, a pigment in which oil absorbency prescribed by JIS-K5101 is 40 ml/100 g (cc/100 g) or more is preferably used. Specific examples of the pigment include calcium carbonate, barium sulphate, aluminum hydroxide, kaolin, calcined kaolin, amorphous silica, urea-formaline resin powder, and the like. Among these pigments, calcined kaolin having an oil absorbency of 70 to 80 ml/100 g is particularly preferable.

Further, an amount of the pigment to be applied to the substrate is 2 $g/m^2$ or greater, preferably 4 $g/m^2$ or greater, and most preferably 7 to 12 $g/m^2$.

Examples of binders used for the above-described undercoat layer include water-soluble polymers and water-soluble binders. These binders may be used singly or may be used in a combination of two or more. Examples of the water-soluble polymer include starch, polyvinyl alcohol, polyacrylamide, carboxymethyl alcohol, methylcellulose, or casein.

The water-soluble binder is generally a synthetic rubber latex or a synthetic resin emulsion. Examples of the water-soluble binder include styrene-butadiene rubber latex, acrylonitrile-butadiene rubber latex, methyl acrylate-butadiene rubber latex, vinyl acetate emulsion, and the like.

An amount of the binder used is 3 to 100% by weight, preferably 5 to 50% by weight, and most preferably 8 to 15% by weight of the total weight of the pigment added to the undercoat layer. Further, waxes, discoloration inhibitors, surfactants, and the like may be added to the undercoat layer.

Generally known coating methods can be used to apply the undercoat layer. Specifically, coating methods using air knife coaters, roll coaters, blade coaters, gravure coaters, curtain coaters, and the like can be used. Among these methods, a coating method using blade coaters is preferably used. Further, if necessary, smoothing such as calendering may also be carried out.

2. Heat-sensitive Coloring Layer

A heat-sensitive coloring layer formed on the substrate contains at least (1) a colorless electron-donating dye, (2) an electron-accepting compound, and (3) a sensitizer, and more preferably, also contains (4) an image stabilizer. Further, the heat-sensitive coloring layer is preferably formed directly on the substrate.

(1) Colorless Electron-donating Dye

Examples of the colorless electron-donating dye include compounds described below. However, the present invention is not limited to the same. Namely, examples of the colorless electron-donating dye that colors to black, include 3-di(n-butylamino)-6-methyl-7-anilinofluoran, 2-anilino-3-methyl-6-N-ethyl-N-sec-butylaminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-[N-(3-ethoxypropyl)-N-ethylamino)-6-mehyl-7-anilinofluoran, 3-di(n-butylamino)-7-(2-chloroanilino)fluoran, 3-diethylamino-7-(2-chloroanilino)fluoran, 3-diethylamino-6-methyl-7-anilinofluoran, and 3-(N-cyclohexyl-N-methylamino)-6-methyl-7-anilinofluoran.

Among these compounds, 3-di(n-butylamino)-6-methyl-7-anilinofluoran and 2-anilino-3-methyl-6-N-ethyl-N-sec-butylaminofluoran are preferable from the standpoint of low fogging at non-image portions.

An amount of the colorless electron-donating dye applied is preferably 0.1 to 1.0 g/m$^2$, more preferably 0.2 to 0.8 g/m$^2$, and most preferably 0.2 to 0.5 g/m$^2$ from the viewpoint of high coloring density and low fogging at non-image portions.

(2) Electron-accepting Compound

The heat-sensitive recording material of the present invention is characterized in that it contains 4,4'-dihydroxydiphenylsulfone as an electron-accepting compound.

An amount of the electron-accepting compound added is preferably 10 to 400% by weight, more preferably 50 to 300% by weight, and most preferably 100 to 250% by weight based on the total weight of the colorless electron-donating dye.

As the electron-accepting compound of the present invention, other generally known electron-accepting compounds may be used together with 4,4'-dihydroxydiphenylsulfone so long as the effects of the present invention are not impaired.

Generally known electron-accepting compounds can be suitably selected and used. Particularly, phenol compounds, or derivatives of salicylic acid and metal salts thereof are preferable from the standpoint of suppressing fogging at non-image portions.

Examples of the phenol compound include 2,2'-bis(4-hydroxyphenol)propane (bisphenol A), 4-t-butylphenol, 4-phenylphenol, 4-hydroxydiphenoxide, 1,1 '-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidenediphenol, 4,4'-sec-butylilenediphenol, 4-tert-octylphenol, 4-p-methylphenylphenol, 4,4'-methylcyclohexylidenephenol, 4,4'-isopentylidenephenol, 4-hydroxy-4-isopropyloxydiphenylsufone, p-hydroxy benzyl benzoate, and the like.

Further, examples of the derivatives of salicylic acid include 4-pentadecylsalicylic acid, 3-5-di(a -methyl benzyl) salicylic acid, 3,5-di(tert-octyl)salicylic acid, 5-octadecylsalicylic acid, 5-α-(p-α-methylbenzylphenyl) ethylsalicylic acid, 3-α-methylbenzyl-5-tertoctylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper, and lead salts thereof.

When generally known electron-accepting compounds are used together with 4,4'-dihydroxydiphenylsulfone in the present invention, an amount of 4,4'-dihydroxydiphenylsulfone contained is preferably 50% by weight or more, more preferably 70% by weight or more, and particularly preferably 90% by weight or more based on the total weight of the electron-accepting compound.

When a coating liquid for a heat-sensitive coloring layer is prepared in the present invention, it is preferable that the weight average particle diameter of particles of the electron-accepting compound is 1.0 μm or less, more preferably 0.3 to 0.9 μm, and most preferably 0.5 to 0.7 μm. If the weight average particle diameter exceeds 1.0 μm, heat sensitivity may decrease. The weight average particle diameter can be easily measured by an apparatus for measuring distribution of particle diameters by laser diffraction (for example, LA 500 manufactured by Horiba Ltd.).

(3) Sensitizer

The heat-sensitive recording material of the present invention is characterized in that it contains a sensitizer comprising 2-benzyloxynaphthalene and aliphatic monoamide. The mass ratio between 2-benzyloxynaphthalene and aliphatic monoamide is in the range from 30/70 to 70/30, and particularly preferably in the range from 40/60 to 60/40.

If the mass ratio between 2-benzyloxynaphthalene and aliphatic monoamide is less than 30/70, sensitivity becomes low. Further, if the mass ratio is greater than 70/30, sensitivity becomes low as well.

The aliphatic monoamide comprises stearic acid amide and palmitic acid amide. An aliphatic monoamide comprising 65 to 95% by weight of stearic acid amide and 5 to 35% by weight of palmitic acid amide is preferably used. When the sensitizer comprising the above-described compounds is contained in the heat-sensitive coloring layer, sensitivity can be further improved.

The amount of the above-described sensitizer contained is preferably in a range of 75 to 200 parts by weight, and more preferably in a range of 100 to 150 parts by weight based on 100 parts by weight of 4,4'-dihydroxydiphenylsulfone, which is the electron-accepting compound. When the amount of the sensitizer contained is in a range of 75 to 200 parts by weight, the effect of improvement in sensitivity is great and image preservability is excellent.

In addition to 2-benzyloxynaphthalene and aliphatic monoamide, which are the sensitizer of the present invention, other generally known sensitizers may also be used together therewith so long as the effects of the present invention are not impaired.

Specific examples of the generally known sensitizers include stearyl urea, p-benzylbiphenyl, di(2-methylphenoxy)ethane, di(2-methoxyphenoxy)ethane, β-naphthol-(p-methylbenzyl)ether, α-naphtylbenzyl ether, 1,4-butanediol-p-methylphenyl ether, 1,4-butanediol-p-isopropylphenyl ether, 1,4-butanediol-p-tertoctylphenyl ether, 1-phenoxy-2-(4-etylphenoxy)ethane, 1-phenoxy-2-(chlorophenoxy)ethane, 1,4-butanediolphenyl ether, diethylene glycol bis(4-methoxyphenyl) ether, m-tarphenyl, oxalic methylbenzyl ether, 1,2-diphenoxymethylbenzene, 1,2-bis(3-methylphenoxy)ethane, 1,4-bis(phenoxymethyl)benzene, and the like.

(4) Image Stabilizer

Further, in the heat-sensitive coloring layer, 1,1,3-tris(2-methyl-4-hydroxy-5-tert-butylphenyl)butane is preferably used as an image stabilizer. When the image stabilizer is contained in the heat-sensitive coloring layer, fogging at non-image portions is reduced due to interaction between 4,4'-dihydoxydiphenylsulfone, which is the electron-accepting compound, and 2-benzyloxynaphthalene and aliphatic monoamide, which are the sensitizer, whereby preservability of image portions can be further improved.

An amount of the image stabilizer used is preferably 10 to 100 parts by weight, more preferably 30 to 60 parts by weight, and most preferably 40 to 55 parts by weight based on 100 parts by weight of the electron-donating colorless dye from the standpoint of efficiently exhibiting the desired effect of image preservability.

In addition to 1,1,3-tris(2-methyl-4-hydroxy-5-tert-butylphenyl)butane which is the image stabilizer of the present invention, other generally known image stabilizers may also be used together therewith so long as the effects of the present invention are not impaired.

As the above-described generally known image stabilizer, phenol compounds, and in particular, hindered phenol compounds, are effective. Examples thereof include 1,1,3-tris(2-methyl-4-hydroxy-tert-butylphenyl) butane, 1,1,3-tris (2-ethyl-4-hydroxy-5-cyclohexylphenyl) butane, 1,1,3-tris (3,5-di-tert-butyl-4-hydroxyphenyl) butane, 1,1,3-tris (2-methyl-4-hydroxy-5-tert-butylphenyl) propane, 2, 2'-methylene-bis(6-tert-butyl-4-methylphenol), 2,2'-methylene-bis(6-tert-butyl-4-ethylphenol), 4,4'-butylidene-bis(6-tert-butyl-3-methylphenol), 4,4'-thio-bis-(3-methyl-6-tert-butylphenol), and the like.

In the present invention, the colorless electron-donating dye, electron-accepting compound, sensitizer, and the like are dispersed in a water-soluble binder. The water-soluble binder used herein is preferably a compound in which 5 parts by weight or more thereof is dissolved in water of 25° C.

Specific examples of the above-described water-soluble binder include polyvinyl alcohol, methyl cellulose, carboxymethylcellulose, starches (including modified starch), gelatin, gum arabic, casein, saponified compound of styrene-maleic anhydride copolymer, and the like.

These binders are used not only for the purpose of dispersion, but also for the purpose of improving the strength of a coated film of the heat-sensitive coloring layer. For the purpose of improving the strength of a coated film of the heat-sensitive coloring layer, synthetic polymer latex based binders such as styrene-butadiene copolymer, vinyl acetate copolymer, acrylonitrile-butadiene copolymer, methyl acrylate-butadiene copolymer, and polyvinylidene chloride can be used together with the water-soluble binders.

The above-described colorless electron-donating dye, electron-accepting compound, sensitizer, and the like are dispersed simultaneously or separately by a stirring/pulverizing machine such as a ball mill, an attriter, or a sand mill, whereby a coating liquid is prepared. The coating liquid may further contain, as occasion demands, various pigments, metallic soaps, waxes, surfactants, antistatic agents, ultraviolet ray absorbents, defoaming agents, fluorescent dyes, or the like.

Examples of pigments that may be used include calcium carbonate, barium sulfate, lithopone, agalmatolite, kaolin, calcined kaolin, amorphous silica, aluminum hydroxide, and the like. Examples of the metallic soap include higher fatty acid metallic salts such as zinc stearate, calcium stearate, aluminum stearate, and the like.

Examples of the waxes include paraffin wax, micro crystalline wax, carnauba wax, methylol stearamide, polyethylene wax, polystyrene wax, fatty acid amide based wax, and the like. These waxes may be used singly or in a combination of two or more. Examples of the surfactants include sulfosuccinate-based alkali metal salts, fluorine-containing surfactants, and the like.

These materials are mixed together, and thereafter applied to the substrate. There are no particular limitation on the instrument used to apply the materials to the substrate, nor are there particular limitations on the method by which the materials are coated on the substrate. For example, air knife coaters, roll coaters, blade coaters, or curtain coaters may be used. Subsequently, the coated film is dried and subjected to smoothing processing using a calender. Particularly, a curtain coater is preferably used in the present invention.

An amount of the heat-sensitive coloring layer to be coated is not limited, but is preferably 2 to 7 g/m$^2$ in a normal dry weight.

A protective layer may be provided on the heat-sensitive coloring layer as needed. The protective layer may contain organic or inorganic fine powders, binders, surfactants, heat-fusible materials, or the like. As the fine powder, for example, inorganic fine powder such as calcium carbonate, silica, zinc oxide, titanium oxide, aluminum hydroxide, zinc hydroxide, barium sulfate, clay, talc, or surface-treated calcium or silica, or organic fine powder such as urea-formalin resin, styrene-methacrylic acid copolymer, or polystyrene can be used.

As the binder contained in the protective layer, polyvinyl alcohol, carboxy-modified polyvinyl alcohol, vinyl acetate-acrylamide copolymer, silicon-modified polyvinyl alcohol, starch, modified starch, methyl cellulose, carboxymethylcellulose, hydroxymethylcellulose, gelatins, gum arabic, casein, styrene-maleic acid copolymer hydrolysate, derivatives of polyacrylamide, polyvinyl pyrolidone, and latices such as styrene-butadiene rubber latex, acrylonitrile-butadiene rubber latex, methyl acrylate-butadiene rubber latex, or vinyl acetate emulsion can be used.

Further, a waterproof agent may also be added with the binder components in the protective layer being cross-linked for the purpose of further improving preservation stability of the heat-sensitive recording material. Examples of the waterproof agent include water-soluble initial condensates such as N-methylol urea, N-methylol melamine, or urea-formalin, dialdehyde compounds such as glyoxal or glutaraldehyde, inorganic cross-linking agents such as boric acid, borax, or colloidal silica, polyamide epichlorohydrin, and the like.

EXAMPLES

The present invention will be hereinafter described specifically with reference to Examples below. The present invention is not limited to the Examples. In the Examples, "parts" and "%" represent "parts by weight" and "% by weight" respectively.

Example 1

Formation of Heat-sensitive Recording Material

Preparation of Coating Liquid for Heat-sensitive Coloring Layer:

1. Preparation of Dispersion Liquid A

The following components were dispersed and mixed by a ball mill to obtain a dispersion liquid A having an average particle diameter of 0.6 $\mu$m.

Composition of Dispersion Liquid A

| | |
|---|---|
| 3-dibutylamino-6-methyl-7-anilinofluorane (colorless electron-donating dye) | 10 parts |
| 2.5% aqueous solution of polyvinyl alcohol (PVA-105; manufactured by Kuraray Co., Ltd.) | 50 parts |

2. Preparation of Dispersion Liquid B

The following components were dispersed and mixed by a ball mill to obtain a dispersion liquid B having an average particle diameter of 0.6 μm.

Composition of Dispersion Liquid B

| | |
|---|---|
| 4,4'-dihydroxydiphenylsulfone (electron-accepting compound) | 20 parts |
| 2.5% aqueous solution of polyvinyl alcohol (PVA-105; manufactured by Kuraray Co., Ltd.) | 100 parts |

(3) Preparation of Dispersion Liquid C

The following components were dispersed and mixed by a ball mill to obtain a dispersion liquid C having an average particle diameter of 0.6 μm.

Composition of Dispersion Liquid C

| | |
|---|---|
| 2-benzyloxynaphthalene (component of sensitizer) | 20 parts |
| 2.5% aqueous solution of polyvinyl alcohol (PVA-105; manufactured by Kuraray Co., Ltd.) | 100 parts |

(4) Preparation of Dispersion Liquid D

The following components were dispersed and mixed by a ball mill to obtain a dispersion liquid D having an average particle diameter of 0.8 μm.

Composition of Dispersion Liquid D

| | |
|---|---|
| 1,1,3-tris(2-methyl-4-hydroxy-5-tert-butylphenyl)butane (image stabilizer) | 5 parts |
| 2.5% aqueous solution of polyvinyl alcohol (PVA-105; manufactured by Kuraray Co., Ltd.) | 25 parts |

(5) Preparation of Pigment Dispersion Liquid E

The following components were dispersed and mixed by a sand mill to obtain a pigment dispersion liquid E having an average particle diameter of 2.0 μm.

Composition of Pigment Dispersion Liquid E

| | |
|---|---|
| soft calcium carbonate | 40 parts |
| sodium polyacrylate | 1 parts |
| distilled water | 60 parts |

A coating liquid for a heat-sensitive coloring layer was obtained by mixing compounds having the following composition.

Composition of Coating Liquid for Heat-sensitive Coloring Layer

| | |
|---|---|
| dispersion liquid A | 60 parts |
| dispersion liquid B | 120 parts |
| dispersion liquid C | 120 parts |

-continued

| | |
|---|---|
| dispersion liquid D | 30 parts |
| pigment dispersion liquid E | 101 parts |
| Fatty acid monoamide emulsion dispersion liquid (component of sensitizer; concentration of solid components: 20%) (composition of 70% by weight of stearic amide and 30% by weight of palmitic amide) | 50 parts |
| 30% dispersion liquid of zinc stearate | 15 parts |
| Sodium dodecylbenzenesulfonate (25%) | 4 parts |

Formation of Heat-sensitive Recording Material:

An undercoat layer containing a pigment and a binder as main components was applied, in an amount forming a dried layer of 8 g/m$^2$, by a blade coater on a base paper having a basic weight of 50 g/m$^2$ over five seconds by steckigt sizing to thereby prepare an undercoat base paper. Subsequently, the coating liquid for a heat-sensitive recording material was applied onto the undercoat layer by a curtain coater in an amount forming a dried layer of 4 g/m$^2$ and thereafter dried. The surface of the formed heat-sensitive coloring layer was subjected to calendering to obtain the heat-sensitive recording material of Example 1.

Example 2

A heat-sensitive recording material of Example 2 was obtained in the same way as in Example 1 except that the dispersion liquid C was changed from 120 parts to 90 parts and the fatty acid monoamide emulsified dispersion liquid was changed from 50 parts to 75 parts.

Example 3

A heat-sensitive recording material of Example 3 was obtained in the same way as in Example 1 except that the dispersion liquid C was changed from 120 parts to 60 parts and the fatty acid monoamide emulsified dispersion liquid was changed from 50 parts to 100 parts.

Example 4

A heat-sensitive recording material of Example 4 was obtained in the same way as in Example 2 except that the fatty acid monoamide emulsified dispersion liquid was changed to an emulsified dispersion liquid in which 75 parts of a composition comprising 94% by weight of stearic acid amide and 6% by weight of paltimic acid amide was used.

Example 5

A heat-sensitive recording material of Example 5 was obtained in the same way as in Example 1 except that the dispersion liquid C was changed from 120 parts to 60 parts.

Example 6

A heat-sensitive recording material of Example 6 was obtained in the same way as in Example 1 except that the fatty acid monoamide emulsified dispersion liquid was changed from 50 parts to 100 parts.

Example 7

A heat-sensitive recording material of Example 7 was obtained in the same way as in Example 1 except that the dispersion liquid D was changed from 30 parts to 12 parts.

Example 8

A heat-sensitive recording material of Example 8 was obtained in the same way as in Example 2 except that the fatty acid monoamide emulsified dispersion liquid was changed to a composition comprising 50% by weight of stearic acid amide and 50% by weight of paltimic acid amide.

Example 9

A heat-sensitive recording material of Example 9 was obtained in the same way as in Example 1 except that the dispersion liquid C was changed from 120 parts to 30 parts and the fatty acid monoamide emulsified dispersion liquid was changed from 50 parts to 25 parts.

Example 10

A heat-sensitive recording material of Example 10 was obtained in the same way as in Example 1 except that the dispersion liquid C was changed from 120 parts to 150 parts and the fatty acid monoamide emulsified dispersion liquid was changed from 50 parts to 125 parts.

Comparative Example 1

A heat-sensitive recording material of Comparative Example 1 was obtained in the same way as in Example 1 except that the dispersion liquid C was changed from 120 parts to 30 parts and the fatty acid monoamide emulsified dispersion liquid was changed from 50 parts to 125 parts.

Comparative Example 2

A heat-sensitive recording material of Comparative Example 2 was obtained in the same way as in Example 1 except that the dispersion liquid C was changed from 120 parts to 150 parts and the fatty acid monoamide emulsified dispersion liquid was changed from 50 parts to 25 parts.

Comparative Example 3

A heat-sensitive recording material of Comparative Example 3 was obtained in the same way as in Example 1 except that 4,4'-dihydroxydiphenylsulfone of the dispersion liquid B was changed to 2,2-bis(4-hydroxyphenyl)ethane.

Evaluation (1) Sensitivity

Printing on each of the heat-sensitive recording materials obtained in Examples 1 to 10 and Comparative Examples 1 to 3 was carried out by using a heat-sensitive printing apparatus having a thermal head (KJT-216–8 MPD1) manufactured by Kyocera Corp. and a pressure roll of 100 kg/cm$^2$ located directly before the head. The printing was carried out while using the pressure roll under a head voltage of 24 V, a pulse cycle of 10 ms, and a pulse width of 2.1 ms, and the density of printing was measured by using a Macbeth reflection densitometer (RD-918). The results are shown in Table 1.

(2) Fogging at Non-image Portions

The heat-sensitive recording materials obtained in Examples 1 to 10 and Comparative Examples 1 to 3 were each left in an environment for 24 hours at 60° C. and at a relative humidity of 20%. Thereafter, non-image portions of each material were measured by a Macbeth reflection densitometer (RD-918). The results are shown in Table 1. As a numerical value becomes smaller, a more excellent effect is obtained.

(3) Image Preservability

An image was recorded on each of the heat-sensitive recording materials obtained in Examples 1 to 10 and Comparative Examples 1 to 3 by using the same apparatus and under the same conditions as those used and specified in the above-described measurement of sensitivity. The heat-sensitive recording material were left in an environment for 24 hours at 60° C. and at a relative humidity of 20%. Subsequently, the density of the obtained image was measured by using a Macbeth reflection densitometer (RD-918). Residual rate for the density of the unprocessed (left) image recorded by using the same apparatus and under the same conditions as those used and specified in the above-described measurement of the sensitivity, was calculated from the following expression. The results are also shown in Table 1. As the numerical value becomes higher, image preservability improves.

image preservability (%)=(density of image after standing/density of unprocessed image)×100

(4) Resistance to Ink Jet Sheet

An ink jet sheet printed by using an ink jet printer (MJ930C; manufactured by Seiko Epson Corporation) in a super fine mode and a heat-sensitive recording material with an image being recorded by using the same apparatus and same conditions as those used and specified in the above-described measurement of sensitivity were made to overlap each other with respective recording surfaces contacting each other, and left for 48 hours at 25° C. and at a relative humidity of 50%. Thereafter, the ink jet sheet was separated from the heat-sensitive recording material, and the density of the image on the heat-sensitive recording material was measured by using a Macbeth reflection densitometer (RD-918) and a residual rate for the density of an unprocessed (non-contact) image recorded by using the same apparatus and same conditions as those used and specified in the above-described measurement of sensitivity was calculated from the following equation. The results are also shown in Table 1. As the numerical value becomes higher, the resistance of ink jet sheet improves.

resistance of ink jet sheet (%)=(density of an image fading out due to heat-sensitive recording material and ink jet sheet contacting/density of an unprocessed image)×100

TABLE 1

| | Sensitivity | Fogging at non-image portions | image preservability | resistance of ink jet sheet |
|---|---|---|---|---|
| Example 1 | 1.28 | 0.08 | 85% | 85% |
| Example 2 | 1.31 | 0.08 | 83% | 85% |
| Example 3 | 1.27 | 0.09 | 78% | 82% |
| Example 4 | 1.29 | 0.08 | 82% | 82% |
| Example 5 | 1.29 | 0.07 | 83% | 80% |
| Example 6 | 1.31 | 0.08 | 75% | 78% |
| Example 7 | 1.31 | 0.08 | 73% | 78% |
| Example 8 | 1.32 | 0.10 | 70% | 70% |
| Example 9 | 1.25 | 0.08 | 67% | 80% |
| Example 10 | 1.28 | 0.10 | 68% | 73% |
| Comparative Example 1 | 1.22 | 0.12 | 45% | 70% |
| Comparative Example 2 | 1.21 | 0.12 | 58% | 75% |
| Comparative Example 3 | 1.33 | 0.10 | 48% | 35% |

It can be seen from Table 1 that the heat-sensitive recording materials obtained in the Examples of the present invention each have a high sensitivity and a low fog level of a non-image portion and also have excellent preservation stability of a color formation image and resistance of ink jet sheet.

As described above, the heat-sensitive recording material of the present invention has high coloring density, low fogging at non-image portions, and excellent preservability of image portions as compared with conventional heat-sensitive recording materials.

What is claimed is:

1. A heat-sensitive recording material comprising:

a substrate; and a heat-sensitive coloring layer formed on the substrate, the heat-sensitive coloring layer including (a) a colorless electron-donating dye, (b) an electron-accepting compound including at least 4,4'-dihydroxydiphenylsulfone, and (c) a sensitizer comprising 2-benzyloxynaphthalene and aliphatic monoamide, wherein a mass ratio between 2-benzyloxynaphthalene and aliphatic monoamide is in a range of 1/2 to 2/1.

2. The heat-sensitive recording material of claim 1, wherein the aliphatic monoamide comprises 65 to 95% by weight stearic acid amide and 5 to 35% by weight palmitic acid amide.

3. The heat-sensitive recording material of claim 1, wherein an amount of the sensitizer included in the heat-sensitive coloring layer is in a range of 75 to 200 parts by weight based on 100 parts by weight of 4,4'-dihydroxydiphenylsulfone.

4. The heat-sensitive recording material of claim 1, wherein the heat-sensitive coloring layer further includes 1,1,3-tris(2-methyl-4-hydroxy-5-tert-butylphenyl)butane as an image stabilizer.

5. The heat-sensitive recording material of claim 4, wherein the amount of the image stablilizer is in a range of 10 to 100 parts by weight based on 100 parts by weight of the colorless electron-donating dye.

6. The heat-sensitive recording material of claim 1, wherein the substrate comprises a smoothness of 300 to 500 seconds.

7. The heat-sensitive recording material of claim 1, wherein the substrate includes an undercoat layer comprising a pigment as a main component.

8. The heat-sensitive recording material of claim 7, wherein an amount of the pigment when the undercoat layer is applied to the substrate is at least 2 $g/m^2$.

9. The heat-sensitive recording material of claim 1, wherein an amount of the colorless electron-donating dye applied is in a range of 0.1 to 1.0 $g/m^2$.

10. The heat-sensitive recording material of claim 1, wherein an amount of the electron-accepting compound added is in a range of 50 to 400% by weight based on the total weight of the colorless electron-donating dye.

11. The heat-sensitive recording material of claim 1, wherein the electron-accepting compound is selected from the group consisting of phenol compounds, derivatives of salicylic acid and polyvalent metal salts thereof.

12. The heat-sensitive recording material of claim 1, wherein an amount of 4,4'-dihydroxydiphenylsulfone is at least 50% by weight based on the total weight of the electron-accepting compound.

13. The heat-sensitive recording material of claim 1, wherein the electron-accepting compound comprises particles having a weight average particle diameter of 1.0 $\mu$m or less.

14. The heat-sensitive recording material of claim 1, further comprising an image stabilizer, wherein an amount of the image stabilizer is 10 to 100 parts by weight based on 100 parts by weight of the colorless electron-donating dye.

15. The heat-sensitive recording material of claim 1, wherein an amount of the heat-sensitive coloring layer applied is 2 to 7 $g/m^2$ at a dried layer weight.

16. The heat-sensitive recording material of claim 1, wherein the mass ratio between 2-benzyloxynaphthalene and aliphatic monoamide is in a range of 40/60 to 60/40.

17. The heat-sensitive recording material of claim 1, wherein an amount of the sensitizer included in the heat-sensitive coloring layer is 100 to 150 parts by weight based on 100 parts by weight of 4,4'-dihydroxydiphenylsulfone.

18. A method of forming a heat-sensitive recording material, comprising the steps of:

(a) dispersing a colorless electron-donating dye, an electron-accepting compound, comprising at least 4,4'-dihydroxydiphenylsulfone, and a sensitizer comprising 2-benzyloxynaphthalene and aliphatic monoamide in a water-soluble binder to form a coating material, wherein a mass ratio between 2-benzyloxynaphthalene and aliphatic monoamide is in a range of 1/2 to 2/1;

(b) drying a film of the coating material on a substrate to form a heat-sensitive coloring layer; and (c) smoothing the heat-sensitive coloring layer.

* * * * *